United States Patent [19]

Theurer et al.

[11] Patent Number: 4,465,414

[45] Date of Patent: Aug. 14, 1984

[54] FREIGHT TRAIN

[75] Inventors: Josef Theurer, Vienna; Manfred Brunninger; Friedrich Oellerer, both of Linz, all of Austria

[73] Assignee: Franz Plasser Bahnbaumaschinen Industriegesellschaft mbH, Vienna, Austria

[21] Appl. No.: 439,847

[22] Filed: Nov. 8, 1982

[30] Foreign Application Priority Data

Jan. 15, 1982 [AT] Austria ..... 138/82

[51] Int. Cl.[3] ..... B65G 67/08

[52] U.S. Cl. ..... 414/21; 414/342; 414/420; 414/499

[58] Field of Search ..... 414/339, 340, 342, 343, 414/347, 420, 499, 564, 21

[56] References Cited

U.S. PATENT DOCUMENTS 3,323,663 6/1967 Strader ..... 414/339

4,135,631 1/1979 Theurer et al. .

*Primary Examiner*—Robert G. Sheridan

*Attorney, Agent, or Firm*—Kurt Kelman

[57] ABSTRACT

A train of railroad cars for receiving, transporting and discharging bulk material, comprising a succession of cars coupled together for movement along a track in an operating direction, each one of the cars having a frame and a last one of the cars in the operating direction constituting a loading station for the bulk material. A plurality of transport containers for the bulk material is arranged on the car frames, a continuous track extends on the frames of the succession of cars along the train in said direction laterally of the containers, and a mobile gantry crane is mounted on the track for movement therealong to the loading station. A first elongated conveyor for respective ones of the containers is mounted on the last car between the track. A second, independently driven elongated conveyor for respective ones of the containers is mounted below the first elongated conveyor and spaced therefrom by a distance corresponding at least to the height of the containers, the second conveyor extending between two ends thereof, and a respective container transfer platform is arranged in the range of each conveyor end, each transfer platform being linked to the frame of the last car and each transfer platform including a drive for vertically adjusting the transfer platform.

6 Claims, 3 Drawing Figures

FREIGHT TRAIN

Figure 1:
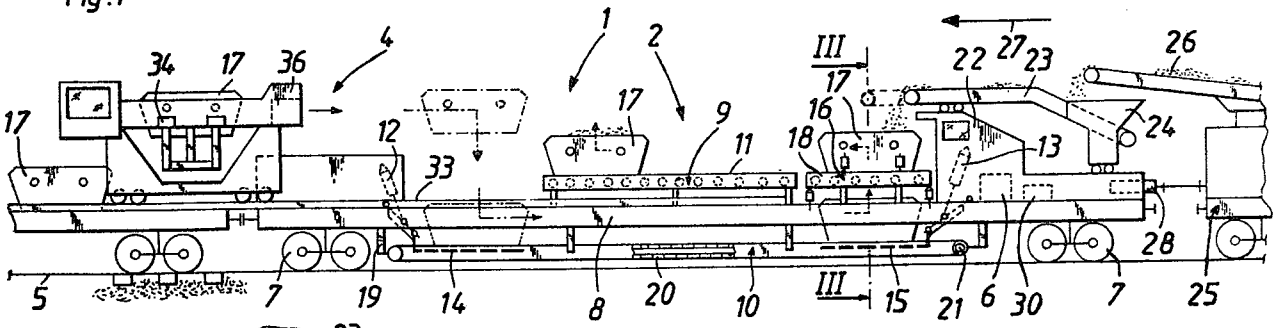

The present invention relates to improvements in a train of railroad cars for receiving, transporting and discharging bulk material, comprising a succession of cars coupled together for movement along a track in an operating direction, each one of the cars having a frame and a last one of the cars in the operating direction constituting a loading station for the bulk material. A plurality of transport containers for the bulk material is arranged on the car frames, each transport container having a height. A continuous track means on the frames of the succession of cars extends along the train in said direction laterally of the containers, and a mobile gantry crane including means for gripping, lifting and pivoting a respective one of the transport containers is mounted on the track means for movement therealong to the loading station. A first elongated conveyor for respective ones of the containers is mounted on the last car between the track means.

U.S. Pat. No. 4,135,631, dated Jan. 23, 1979, discloses such a train, particularly useful in handling the waste material resulting from a railroad bed ballast cleaning operation, wherein the elongated conveyor at the loading station is comprised of an endless conveyor chain mounted on the platform of the last car. Transport containers on this platform are gripped by entrainment elements on the endless conveyor chain and the chain may be selectively driven in opposite directions for movement of the containers to and from the loading station. At an end of the last car adjacent a preceding ballast cleaning machine, a bulk material storage container with a remote-controlled discharge chute is arranged above the elongated conveyor. The material is temporarily stored in the storage container and then discharged into a respective transport container placed under the discharge chute by the conveyor chain. While this arrangement has been quite successful in commercial operations, when the travel path for the mobile crane moving successive transport containers to the last car is rather long and/or when considerable amounts of waste are produced by the ballast cleaning operation, it sometimes happens that the storage container is full before a transport container is moved under the discharge chute unless this storage container has a very large capacity.

It is the primary object of this invention to improve on this arrangement by increasing the capacity thereof and assuring a trouble-free conveyance of the transport containers to and from the loading station.

The above and other objects are accomplished according to the invention by equipping a train of the indicated type with a second, independently driven elongated conveyor for respective ones of the containers mounted below the first elongated conveyor and spaced therefrom by a distance corresponding at least to the height of the containers, and a respective container transfer platform arranged in the range of each conveyor end. Each transfer platform is linked to the frame of the last car and each transfer platform includes a drive for vertically adjusting the transfer platform.

Such a freight train has a simple structure and assures a continuous and trouble-free operation. The two independently operating conveyors enable containers to be moved simultaneously to and from the loading station, thus considerably increasing the capacity of the arrangement and avoiding a troublesome interim storage of the bulk material. The two vertically adjustable transfer platforms at the ends of the second conveyor make it possible independently to transfer respective transport containers between the two elongated conveyors, without any down time. The superposition of the two conveyors make it possible make them wider while still extending within the profile of the car and to move and load the containers at two levels, an empty container standing ready under another container being loaded and this empty container being moved into a loading position promptly upon removal of a filled container, without interruption of the loading operation.

Figure 2:
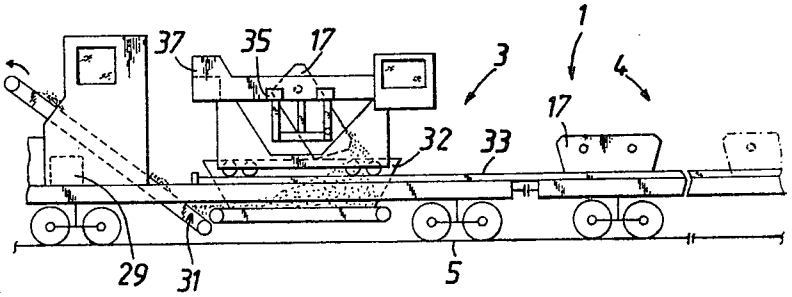
Figure 3:
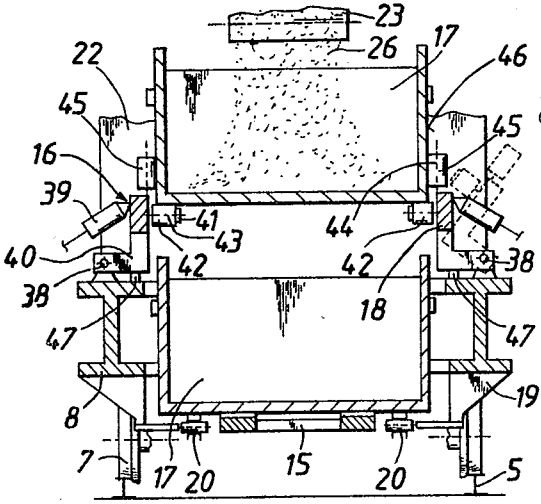

The above and other objects, advantages and features of the present invention will become more apparent from the following detailed description of a now preferred embodiment thereof, taken in conjunction with the accompanying schematic drawing wherein FIGS. 1 and 2, when viewed in horizontal alignment, show a side elevation of the rear portion of a train of railroad cars for receiving, transporting and discharging bulk material received from a partially illustrated ballast cleaning machine; and FIG. 3 is an enlarged transverse section along line III—III of FIG. 1.

Referring now to the drawing and first to FIGS. 1 and 2, there is shown train 1 for receiving, transporting and discharging bulk material, such as waste 26 resulting from a ballast cleaning operation. The train comprises a succession of cars 2, 4, 3 coupled together for movement along track 5 in an operating direction indicated by arrow 27. Each car has frame 8, the cars being flat cars having platforms on which a plurality of transport containers 17 are arranged. Last car 2 constitutes a loading station for the bulk material, front car 3 constitutes a discharge station for the bulk material and a series of flat cars 4 are arranged between the rear and front cars for transporting the containers. Drive 6 is arranged on last car 2 for driving the wheels of at least one of undercarriages 7 on which the car runs on track 5. First elongated conveyor 9 for respective ones of transport containers 17 is mounted on last car 2 above car frame 8 and between undercarriages 7. Track means 33 on the frames of the succession of cars extends along train 1 in the operating direction laterally of containers 17, i.e. the containers are supported on the loading platforms between the track means, and mobile gantry crane 36, 37 including means 34, 35 for gripping, lifting and pivoting a respective one of transport containers 17 is mounted on track means 33 for movement therealong to and from the loading station. According to this invention, second elongated conveyor 10, which is independently driven by drive 21, is mounted below first elongated conveyor 9 and spaced therefrom by a distance corresponding at least to height 46 of containers 17, the second conveyor extending between two ends thereof projecting beyond the first conveyor in the operating direction. Both conveyors extend longitudinally in this direction and a respective container transfer platform 14, 15 is arranged in the range of each end of conveyor 10. Each transfer platform is linked to frame 8 of last car 2 and each transfer platform includes drive 12, 13 for vertically adjusting the transfer platform. In the illustrated embodiment, upper conveyor 9 is a roller conveyor 11 whose driven rollers extend transversely to the operating direction indicated by arrow 27 and which extends between transfer platforms 14, 15. Parallelogram linkages connect the transfer platforms to frame 8 and hydraulic jacks 12, 13 are linked to these linkages for vertically adjusting the transfer platforms. Continuous track means 33 is substantially coterminous with a trailing one of the second conveyor ends and pivotal means 16 for conveying and holding a respective one of transport containers 17 is arranged above the trailing second conveyor end and adjacent the end of the track means in the operating direction. Means 16 will be described in detail hereinafter in connection with FIG. 3. This preferred arrangement provides a very space-saving construction and assures a particularly fast operation during the transfer of a container from one conveyor to the other. Furthermore, two transport containers may be placed simultaneously next to this pivotal means.

Illustrated lower conveyor 10 is comprised of two endless conveyor chains 20 supported by carrier brackets 19 on frame 8 and extending parallel to each other in the operating direction, the spacing between the two conveyor chains exceeding the width of transfer platforms 14, 15. Each conveyor chain is driven by respective drive 21. This provides a structurally simple and safe manner of vertically adjusting the level of the transfer platforms so as to enable them to transfer a respective transport container securely to the conveyor chains which are driven independently of each other. The chains carry suitable entrainment elements for gripping containers 17 therebetween for conveyance.

Operator's cab 22 is mounted on frame 8 of last car 2 and has a control panel for the operation of the various structural components, including bulk material delivery conveyor band 23 which also extends in the operating direction and is displaceable in this direction by driven guide rollers, the displacement path of the conveyor band being indicated in FIG. 1 in broken lines. The trailing end of conveyor band 23 extends into receptacle 24 whose length corresponds to the displacement path so that the trailing conveyor band end will always be within the receptacle for continuously receiving waste bulk material 26 from a conveyor mounted on ballast cleaning machine 25 coupled to last car 2 of train 1. The front end of conveyor band 23 is arranged for discharging the waste bulk material into a respective transport container 17 held on conveying and holding means 16.

The coupling between ballast cleaning machine 25 and train 1 is shown to comprise distance measuring device 28 equipped with a linear potentiometer. This device is arranged to control drive 6 for last car 2 and drive 29 for front car 3 in dependence on the measured distance between train 1 and ballast cleaning machine 25. Control 30 is connected to the various drives on last car 2 for actuation thereof in response to control signals.

FIG. 2 shows front car 3 of train 1, any desired number of flat cars 4 being arranged between the last and front cars of the train. Respective transport containers filled at 16 with waste bulk material and transported along track means 33 by mobile gantry cranes 34, 35 are emptied into receptacle 32 on car 3 and the waste is removed from receptacle 32 by conveyor 31.

A preferred container conveying and holding means 16 is shown in FIG. 3. This conveying and holding means is comprised of two L-shaped carrier frames 18, 18 pivoted to frame 8 of last car 2 for laterally pivoting about axes 38, 38 extending in the operating direction (see pivoted position shown in broken lines). Pivoting drive 39 is associated with each carrier frame. A plurality of carrier rollers 42 driven by drives 41 are aligned in succession on each carrier frame 18 and are rotatable about respective axes 43 extending transversely to the operating direction, and a series of upright lateral guide rollers 45 on each carrier frame are rotatable about respective axes 44 extending perpendicularly to axes of rotation 43 of driven carrier rollers 42. As shown in the drawing, rollers 42 and 45 cooperate to hold and guide each container 17 during conveyance. Without in any way interfering with the operation of the other operating components and without projecting beyond the sides of the car, a minor repositioning of carrier frames enables an empty transport container to be lifted from lower conveyor 10 to upper conveyor 9. Furthermore, the carrier and guide rollers are so arranged that the transfer platform carrying a container may be lifted above the carrier rollers while waste bulk material continues to be delivered thereto without interruption. The transport container can be securely placed on the carrier rollers simply by pivoting the carrier frames back while lowering the transfer platform, the driven carrier rollers then conveying the container placed thereon independently of the other conveyors.

In the range of second, independently driven elongated conveyor 10, frame 8 of last car 2 consists of two I-beams spaced from each other so as to permit an unhindered movement of transport containers 17 therebetween. In the illustrated embodiment, weight indicating devices 47 are arranged between the I-beams and each carrier frame 18 for automatically weighing each filled container conveyed and held by conveying and holding means 16. The weight indicating devices transmit a signal corresponding to the weight of the bulk material in the container to control 30 of drives 41 for automatically driving carrier rollers 42 in response to a predetermined loading weight of the container. In other words, upon reaching the predetermined loading weight, the filled container will be moved by carrier rollers 42 onto the rollers of conveyor 9. Meanwhile, an empty container has been placed by lower conveyor 10 on platform 15 underneath conveying and holding means 16, and upon removal of the filled container, the empty container will be lifted into a loading position beneath the leading end of bulk material delivery conveyor 23. This arrangement secures the installation against overloading and relieves the operator from supervising this function, the uniform loading of all containers being thus automatically assured. It will dependably work even with wet and correspondingly heavy bulk material because, regardless of the size of the container and the volume of the bulk material in it, the container will be moved away as soon as it has reached the predetermined weight.

The operation of this bulk material loading and discharging installation will partially be obvious from the above description of its structure and will be further described in detail hereinafter.

The continuous operation of ballast cleaning machine 25 produces a steady stream of waste bulk material 26 which is discharged by a conveyor leading from the ballast cleaning machine to receptacle 24 on the rear end of last car 2 of train 1. Bulk material delivery conveyor 23 has a trailing end extending into receptacle 24 for receiving the bulk material and discharging it at its leading end into an empty container 17 held ready between carrier frames 18, 18 of conveying and holding means 16. Self-propelled train 1 is held at a set distance from self-propelled ballast cleaning machine 25 by distance measuring device 28 constituted by a linear potentiometer which controls drives 6 and 29 of the train so that, even if ballast conditions make it impossible for the ballast cleaning machine to advance at a steady rate during the ballast cleaning operation, the distance of train 1 from the ballast cleaning machine remains more or less constant. To enable the waste bulk material to be distributed evenly in container 17, delivery conveyor 23 is displaceable in the direction of arrow 27, the operator in cab 22 controlling this displacement so that the discharging front end of the conveyor sweeps along the length of the container placed underneath it.

While this container is being filled with the bulk waste material, mobile gantry crane 36 moves an empty transport container from a position on one of the flat cars 4 (indicated in chain-dotted lines in FIG. 2) to a position above transfer platform 14 (indicated in chain-dotted lines in FIG. 1), this platform having been raised by actuation of drive 12 to the level of upper elongated conveyor 9 so that this empty container is supported on this transfer platform. The gantry then proceeds further to the trailing end of conveyor 9 above transfer platform 15 where transport container 15 filled with bulk material stands ready to be gripped by the gantry crane, lifted and moved back over the empty containers stored on the flat cars to a free space on a loading platform of one of flat cars 4, where it is set down. As soon as weight indicating device 47 signals to control 30 that the container has been filled by conveyor 23 to its predetermined weight, the control will actuate drives 41 of carrier rollers 42 so that the filled container will be conveyed by these rollers to roller conveyor 11 whose driven rollers move the filled container to the opposite end of the conveyor. A limit switch will then be actuated to stop further movement of the filled container.

Before this container filling operation has been completed, the empty transport container supported on transfer platform 14 is lowered to the level of second elongated conveyor 10, drive 12 being operated to lower the platform to this level. The entrainment elements on conveyor chains 20 grip the empty transport container and the conveyor moves the container to the trailing end thereof where a limit switch is triggered to discontinue the conveyor movement and to set the empty container down on lowered transfer platform 15. As this happens, filled container 17 held above platform 15 (see FIG. 3) begins to be moved in the direction of arrow 17 while bulk material delivery conveyor 23 continues to discharge the waste material which now falls into the empty container on platform 15 without any interruption of the operation. Transfer platform 15 carrying the container being filled is raised as soon as the upper, filled container has been moved off carrier rollers 42, carrier frames 18 being laterally pivoted into the position shown in broken lines in FIG. 3 to enable the lower container to be raised to the upper level. As soon as this container has reached the level of carrier rollers 42, carrier frames 18 are pivoted back into the upright position shown in full lines in FIG. 3 so that the container is supported on the carrier rollers during the remainder of the filling cycle. Transfer platform 15 is then lowered again, and this cycle is repeated without interruption. To avoid a possible overload of car 2, waste material delivery from ballast cleaning machine 25 by conveyor 23 is stopped automatically, i.e. this conveyor is halted, when two filled containers 17 are on upper elongated conveyor 9.

Depending on the length of train 1, which in turn is a function of the number of flat cars 4 used, several mobile gantry cranes may be used to shorten the transport time for containers 17. In the illustrated embodiment, an additional mobile gantry crane 37 is provided to move a respective filled container 17 from about the middle of train 1 to leading car 3 of the train. If a freight train for carrying away the waste material is placed on a parallel track, discharge conveyor 31 on car 3 may be used to load waste 26 in cars of the freight train.

Obviously, while the present invention has been described in connection with the handling of waste from a ballast cleaning operation, any bulk material may be handled in this manner, such as dirty ballast, soil dug from the sub-grade of the track bed or the like. Also, work train 1 may be coupled to a preceding mobile track maintenance machine.

What is claimed is:

1. In a train of railroad cars for receiving, transporting and discharging bulk material, comprising (a) a succession of cars coupled together for movement along a track in an operating direction,
  (1) each one of the cars having a frame and
  (2) a last one of the cars in the operating direction constituting a loading station for the bulk material, (b) a plurality of transport containers for the bulk material arranged on the car frames, each transport container having a height, (c) a continuous track means on the frames of the succession of cars extending along the train in said direction laterally of the containers, (d) a mobile gantry crane including means for gripping, lifting and pivoting a respective one of the transport containers, the gantry crane being mounted on the track means for movement therealong to the loading station, and (e) a first elongated conveyor for respective ones of the containers mounted on the last car between the track means:.

a second, independently driven elongated conveyor for respective ones of the containers mounted below the first elongated conveyor and spaced therefrom by a distance corresponding at least to the height of the containers, the second conveyor extending between two ends thereof, and a respective container transfer platform arranged in the range of each conveyor end, each transfer platform being linked to the frame of the last car and each transfer platform including a drive for vertically adjusting the transfer platform.

2. The train of claim 1, wherein the ends of the second elongated conveyor project beyond the first conveyor in said direction, the continuous track means is substantially coterminous with a trailing one of the second conveyor ends in said direction, and further comprising a pivotal means for conveying and holding a respective one of the containers, and a pivoting drive means for the conveying and holding means, the conveying and holding means being arranged above the trailing second conveyor end and adjacent the end of the track means in said direction.

3. The train of claim 2, wherein the container conveying and holding means is comprised of two carrier frames pivoted to the frame of the last car for laterally pivoting about an axis extending in said direction, the pivoting drive means consisting of a respective drive for each carrier frame, a plurality of driven carrier rollers aligned in succession on each carrier frame and rotatable about respective axes extending transversely to said direction, and a series of lateral guide rollers on each carrier frame, the lateral guide rollers being rotatable about respective axes extending perpendicularly to the axes of rotation of the driven carrier rollers.

4. The train of claim 3, further comprising a weight indicating device arranged between the frame of the last car and each carrier frame for automatically weighing the container conveyed and held by the conveying and holding means.

5. The train of claim 4, further comprising a control for automatically driving the carrier rollers in response to a predetermined loading weight of the container indicated by the weight indicating device.

6. The train of claim 1, wherein the second conveyor is comprised of two endless conveyor chains extending parallel to each other in said direction, the spacing between the two conveyor chains exceeding the width of the transfer platforms, and a respective drive for each endless conveyor chain.

* * * * *